US006099107A

United States Patent [19]

Ford et al.

[11] Patent Number: 6,099,107

[45] Date of Patent: Aug. 8, 2000

[54] INK JET PRINTER MECHANISM WITH MECHANICALLY LINKED SERVICE STATION CARRIAGE AND MEDIA SUPPORT

[75] Inventors: Thomas David Reid Ford, Royston; Piers Sebastian Harding, Alconbury Weston; Stephen John Grimwade, Upwood; Jonathan Kemp, Gamlingay, all of United Kingdom

[73] Assignee: Neopost Limited, Romford, United Kingdom

[21] Appl. No.: 09/493,667

[22] Filed: Jan. 28, 2000

[30] Foreign Application Priority Data

Jan. 29, 1999 [GB] United Kingdom ..... 9902054

[51] Int. Cl.[7] ..... B41J 2/165; B41J 2/01

[52] U.S. Cl. ..... 347/32; 347/33; 347/104

[58] Field of Search ..... 347/32, 33, 22, 347/8, 101, 104; 400/600.1, 652, 649, 701; 271/2

[56] References Cited

U.S. PATENT DOCUMENTS 4,957,382 9/1990 Delaney et al. ..... 400/649 X 5,467,114 11/1995 Ebinuma et al. ..... 347/32

5,800,083 9/1998 Gaarder et al. .

5,980,018 11/1999 Taylor et al. ..... 347/32 X

FOREIGN PATENT DOCUMENTS 0 495 669 7/1992 European Pat. Off. .

0 696 508 2/1996 European Pat. Off. .

*Primary Examiner*—David F. Yockey

*Attorney, Agent, or Firm*—Shoemaker and Mattare

[57] ABSTRACT

An ink jet printer mechanism is disclosed in which a print receiving medium is supported in a clamp in a printing station and a print head is traversed through the printing station. A service station for the print head is provided adjacent the printing station and the print head is traversed to the service station between printing operations. The service station includes a carriage which is movable by a drive motor to bring capping and wiping elements into engagement with the print head. A mechanical linkage from the carriage opens the clamp when the capping element is aligned for engagement with the print head.

12 Claims, 6 Drawing Sheets

INK JET PRINTER MECHANISM WITH MECHANICALLY LINKED SERVICE STATION CARRIAGE AND MEDIA SUPPORT

BACKGROUND OF THE INVENTION

This invention relates to ink jet printing mechanisms and in particular to a mechanism for supporting a print receiving medium and including a service station for cleaning and capping an ink jet print head.

In ink jet printing apparatus it is known to traverse a print head across a printing station and to provide a service station for cleaning and capping a print head at a location beyond the printing station. In intervals between printing operations the print head is moved beyond the printing station into the service station to be wiped or capped or both. A known form of service station comprises a sled or carriage which is movable in a direction transverse to the direction of traverse of the print head so as to bring the wiper or cap into engagement with the print head.

SUMMARY OF THE INVENTION

According to the present invention an ink jet printer includes a printing station and a service station; print head transport means to move an ink jet print head in traverses in a first direction through the printing station and the service station; said service station including a carriage carrying wiping and capping elements and selectively operable drive means to move the carriage in a second direction transverse to said first direction to bring the wiping and capping elements selectively into engagement with the print head when the print head is located in the service station; support means to support print receiving media at the printing station to receive an imprint by operation of the print head during a traverse of the print head through the printing station; said support means having an open state permitting entry and removal of print receiving media to and from the printing station and a closed state effective to clamp print receiving media in the printing station; and mechanical means operable by movement of the carriage to move the support means between the open and closed states.

BRIEF DESCRIPTION OF THE DRAWING

An embodiment of the invention will now be described by way of example with reference to the drawings in which.

DESCRIPTION OF THE PREFERRED EMBODIMENT

Figure 1:
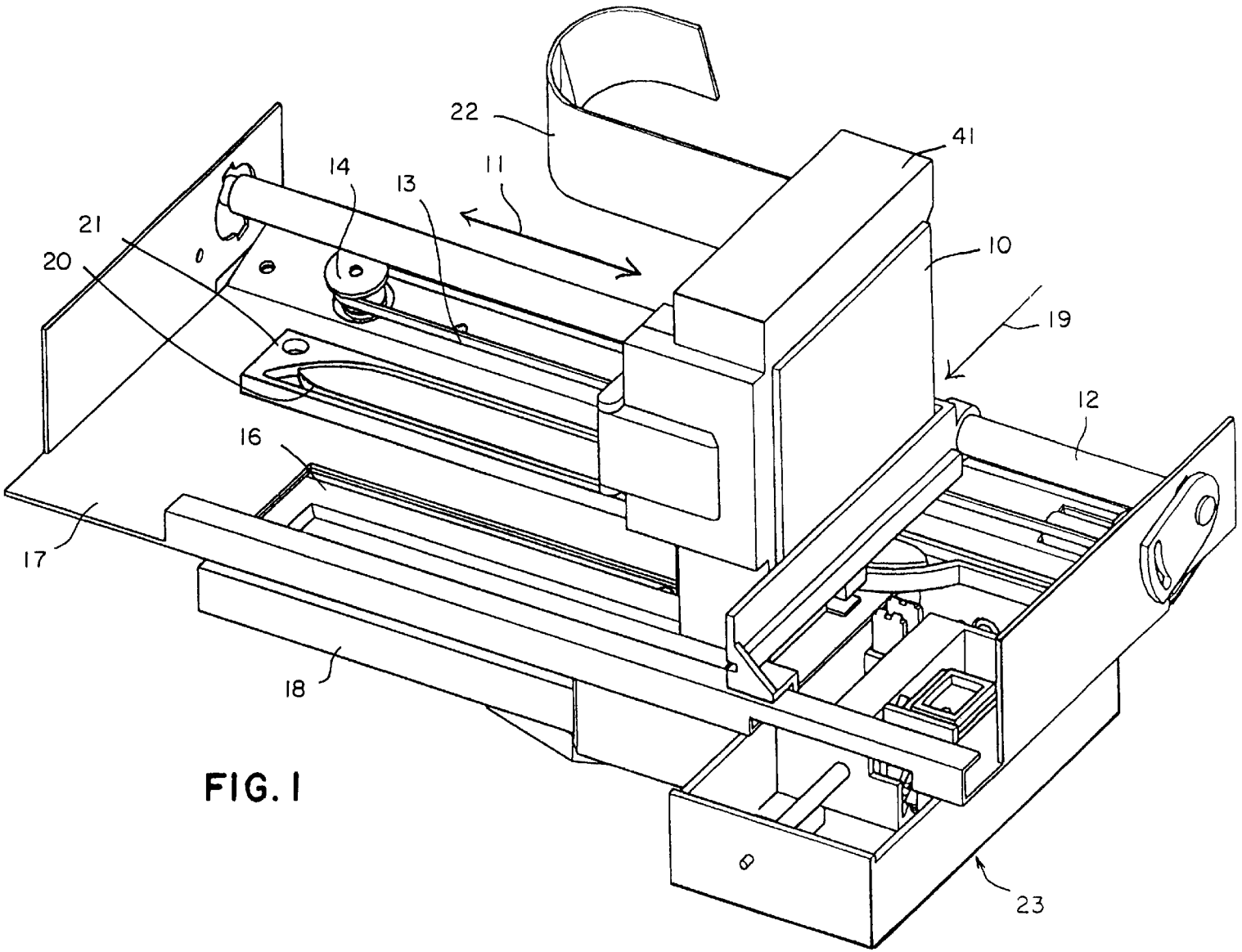
FIG. 1 is a perspective view from above of an ink jet printer.
Figure 2:
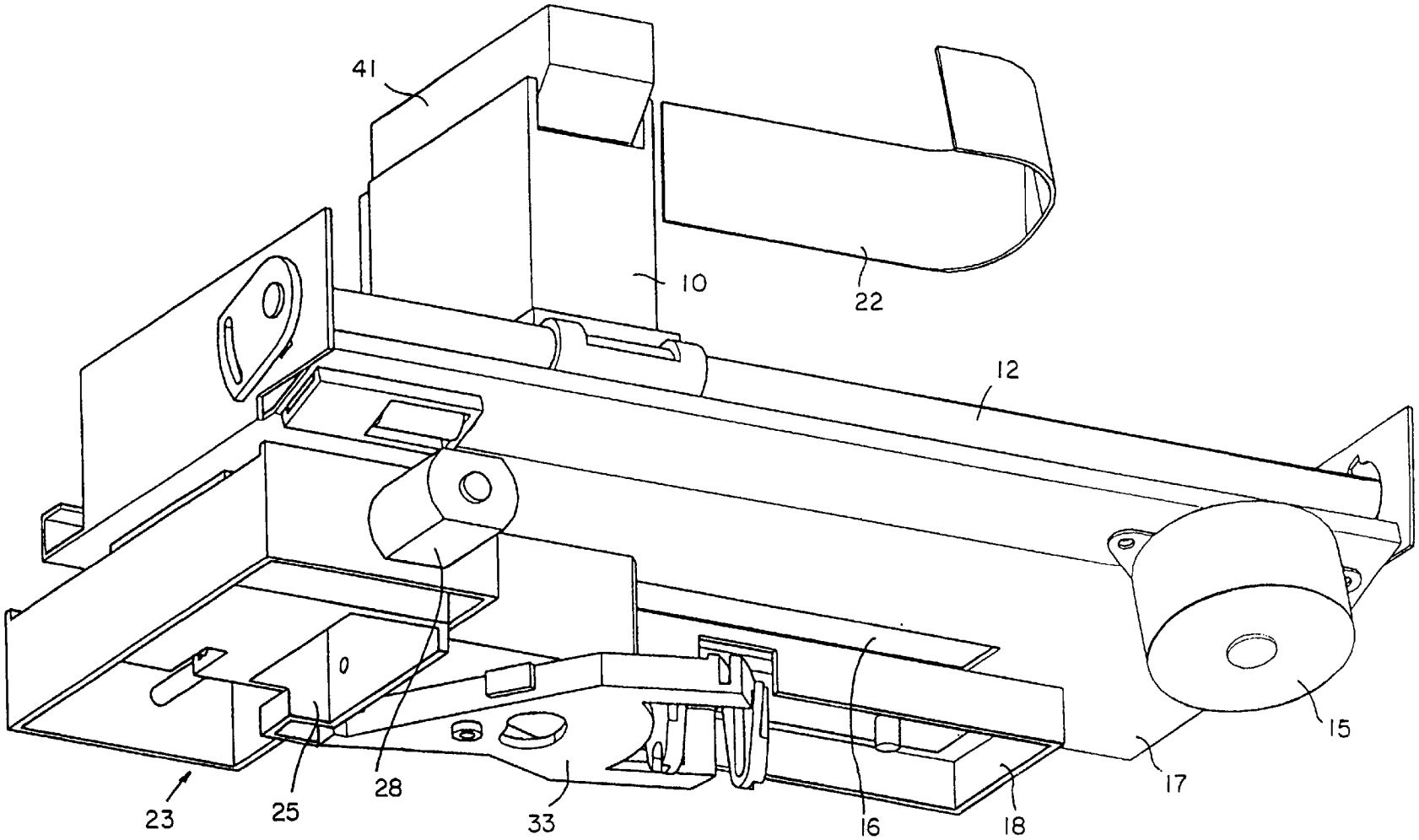
FIG. 2 is a perspective view from below of the printer illustrated in FIG. 1.

Referring first to FIGS. 1 and 2, an ink jet print head 41 is mounted in a print head carriage 10 and the carriage 10 is traversable in a direction indicated by arrow 11 along a guide rod 12. Traversal of the carriage 10 in the direction 11 is effected by a belt 13 that passes around an idler pulley (not shown), a pulley 14 on a shaft of a drive motor 15 and the belt is secured to the carriage. Energisation of the drive motor in first and second senses cause traversal of the carriage in first and second senses respectively in the direction of arrow 11. Traversal of the carriage within a printing station carries the nozzles of an ink jet print head across an aperture 16 in a chassis plate 17. A print receiving medium (not shown) is supported below the chassis plate 17 by a platform 18, the print receiving medium extending across the aperture 16. The platform is movable between a closed clamping position in which a print receiving medium is clamped between the chassis plate 17 and the platform 18 and an open unclamping position in which the platform is spaced from the chassis plate a sufficient distance to permit the free entry and removal from between the chassis plate and the platform of a print receiving medium. During a printing operation the platform is raised to the clamping position so as to hold a print receiving surface of the print receiving medium in engagement with the lower surface of the chassis plate whereby the print receiving surface is maintained at a predetermined spacing from the ink jet nozzles of the print head during traverse of the print head across the aperture in the chassis plate. Accordingly by selective ejection of ink from the ink jet nozzles of the print head as the print head is carried across the aperture, an image is printed on the print receiving medium. The entire image may be printed in a single traverse in one sense of the print head. However if the required image is wider than can be printed in a single traverse of the print receiving medium by the print head, the print head may be caused to move along a first track during traverse in a first sense, from right to left as shown in FIG. 1, and to move along a second track during traverse in a second sense, from left to right as shown in FIG. 1. The print head carriage 10 as shown in FIG. 1 is located at the start of a printing traverse along the first track. The second track is displaced in a direction, indicated by arrow 19, transverse to the direction 11. Accordingly a first band of an image is printed during traverse of the print head in the first sense along the first track and a second band of the image adjoining the first band is printed during traverse of the print head in the second sense along the second track. As shown in FIG. 1, displacement of the print head may be effected by a mechanism that is the subject of our GB patent application 9818026.8 filed Aug. 18, 1998. The print head is mounted in a sub-carriage (not shown) of the carriage 10 that is displaceable relative to the carriage in the direction of arrow 19. Means are provided to engage in a groove 20 of a guide plate 21, secured to the chassis plate 17, and thereby displace the sub-carriage so as to cause the print head to traverse along the second track during traversal of the print head in the second sense.

A flexible ribbon cable 22 provides electrical connections to the print head for conveying electrical power to the print head and for communication of electrical signals between control circuits (not shown) and the print head.

Periodically it is necessary to wipe an operational face in which the ink jet nozzles of the print are located in order to remove accumulation of debris and ink. Also between periods of use of the ink jet print head for printing, the operational face of the print head is sealed by a cap to prevent accumulation of debris and to prevent drying of ink in the nozzles. For these purposes a service station 23 is provided.

Figure 3:
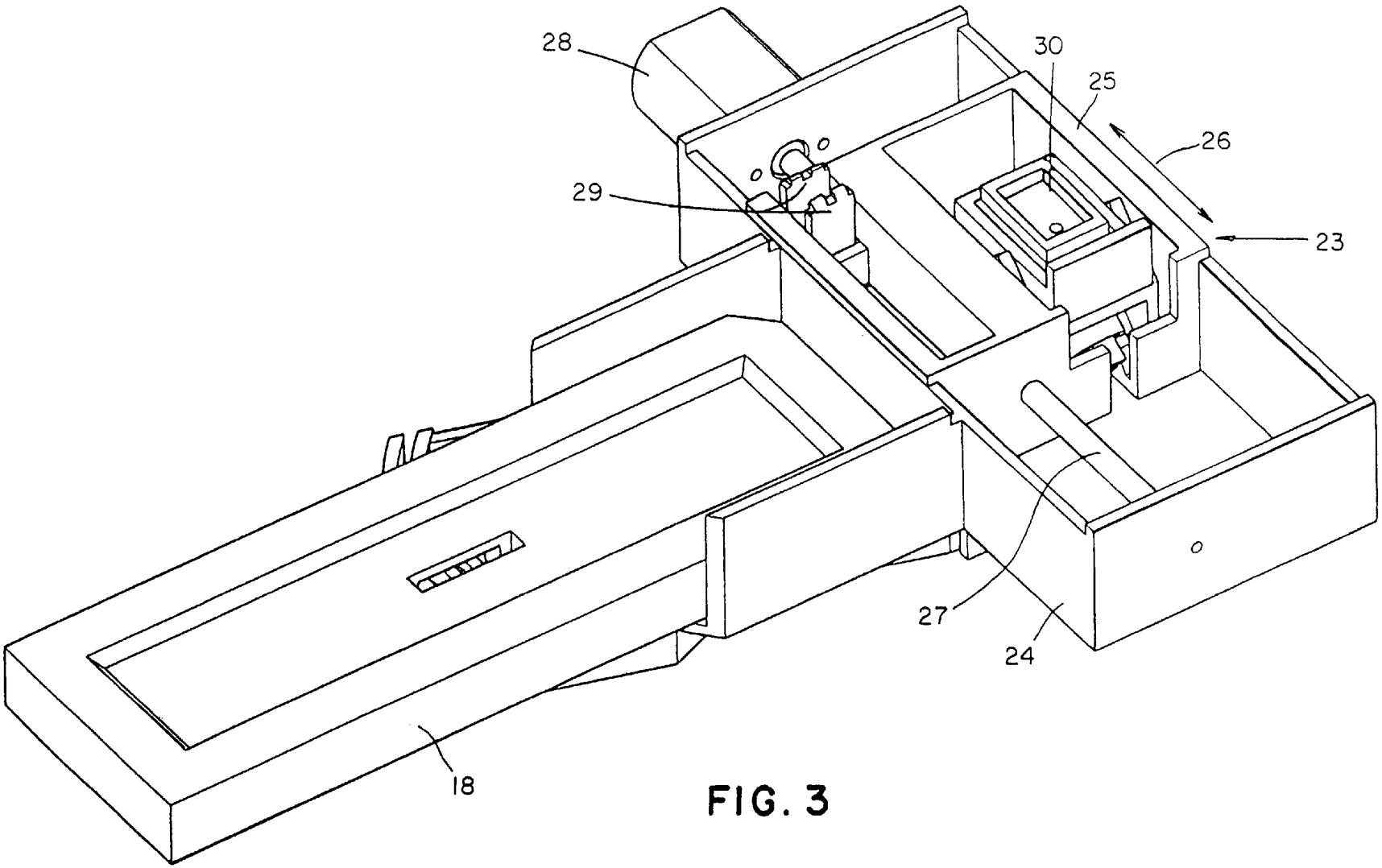
FIG. 3 is a perspective view from above showing a service station for an ink jet print head and a platform for supporting a print receiving medium of the printer of FIG. 1.
Figure 4:
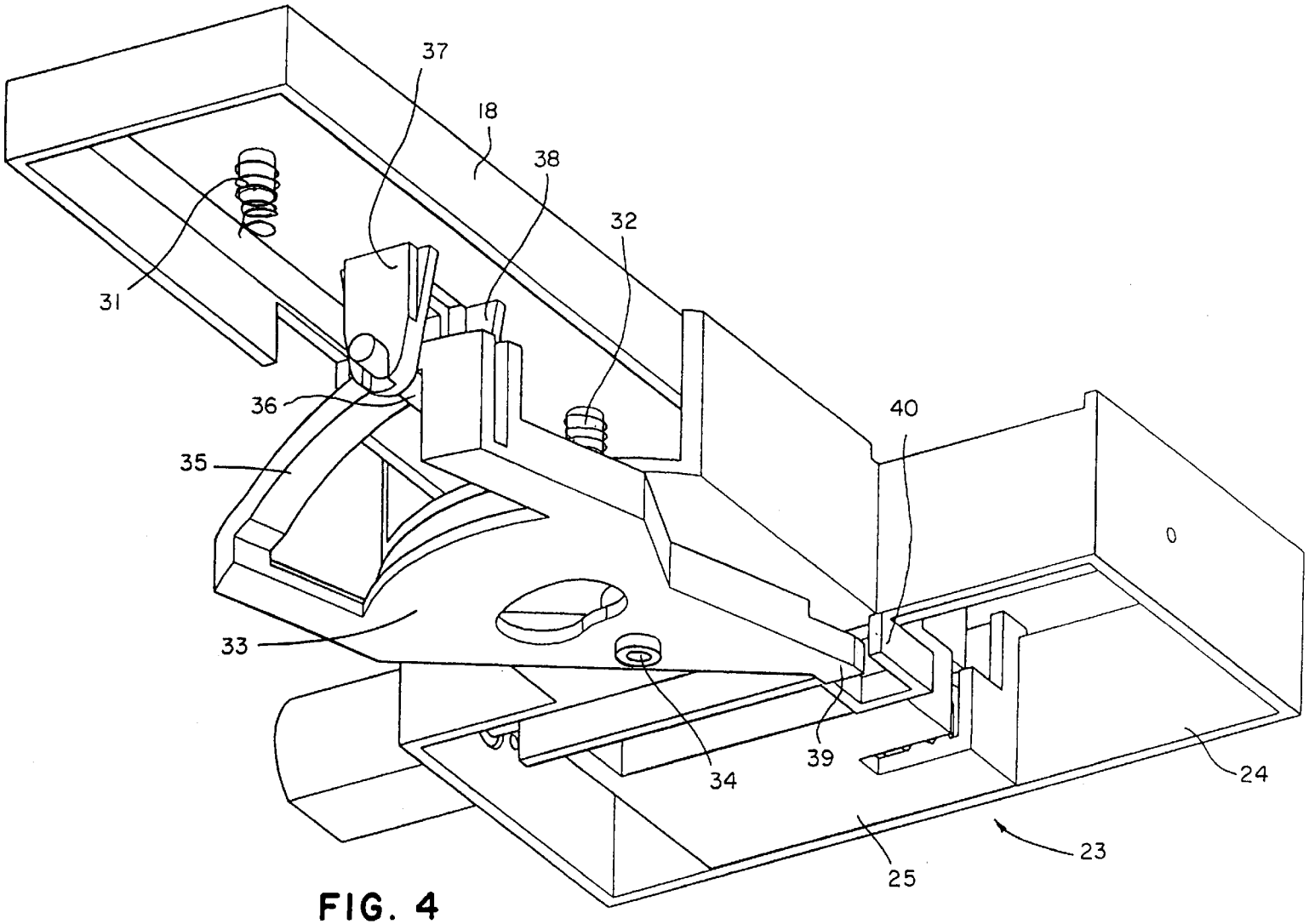
FIG. 4 is a perspective view from below of the service station and platform illustrated in FIG. 3.

Referring to FIGS. 3 and 4, the service station comprises a chassis 24, secured to the chassis plate 17, and a service carriage 25 which is traversable relative to the chassis 24 in a direction, indicated by arrow 26, transverse to the direction of traversal 11 of the print head carriage. traversal of the service carriage is effected by a lead screw 27 driven by a drive motor 28. The service carriage 25 carries wiping elements 29 and a capping element 30. It will be seen from FIG. 1 that the print head carriage may be traversed in the second sense to move the print head beyond the printing position into alignment with the service station 23. As shown in FIG. 3 the wiping elements 29 and the capping element 30 are relatively spaced in the direction of arrow 11 and hence the print head may be moved to a location at the service station aligned either with a path traversed by the wiping elements or by a path traversed by the capping element when the service carriage is traversed in the direction of arrow 26. Accordingly the print head may be subjected selectively to the action of the wiping elements 29 or to be capped by the capping element 30 by locating the print head in alignment with the required element and then energising the drive motor 28 to cause the service carriage to traverse and thereby effect either a wiping or capping of the print head as desired.

As described hereinbefore, the platform 18 is moved between clamping and un-clamping positions to hold and release respectively a print receiving medium. The platform 18 is urged toward the chassis plate 17 by means of compression springs (not shown) which may for example be helical springs having one end thereof located on studs 31, 32 on the underside of the platform 18. Thus the platform is urged into a clamping position by the springs. The platform is movable away from the clamping position to an un-clamping position by means of a cam lever 33. The cam lever is pivotally mounted at 34 on a shaft extending from the chassis 24 and includes, at an end thereof, a cam surface 35. A cam follower 36, mounted on projections 37, 38 extending down from the platform 18, engages the cam surface 35 of the cam lever 33. As shown in FIG. 4, the cam lever is in a rotational position in which the platform is urged into the clamping position by the springs. When the service carriage is driven, from the position illustrated in FIG. 4*a* in a direction right to left as seen in FIG. 4, a drive end 39 of the cam lever 33 remote from the cam surface 35 is engaged by an abutment 40 on the service carriage. As a result of this movement of the service carriage, the cam lever is pivoted about the shaft at 34 an the cam surface acts on the cam follower to move the platform against the action of the springs away from the chassis plate 17 to the un-clamping position. It will be appreciated that the drive end of the cam lever is not engaged by the abutment during movement of the service carriage from the position illustrated in FIG. 4 in an opposite direction, i.e in a direction left to right as seen in FIG. 4 and hence the platform remains in the clamping position during this movement of the service carriage.

Figure 5:
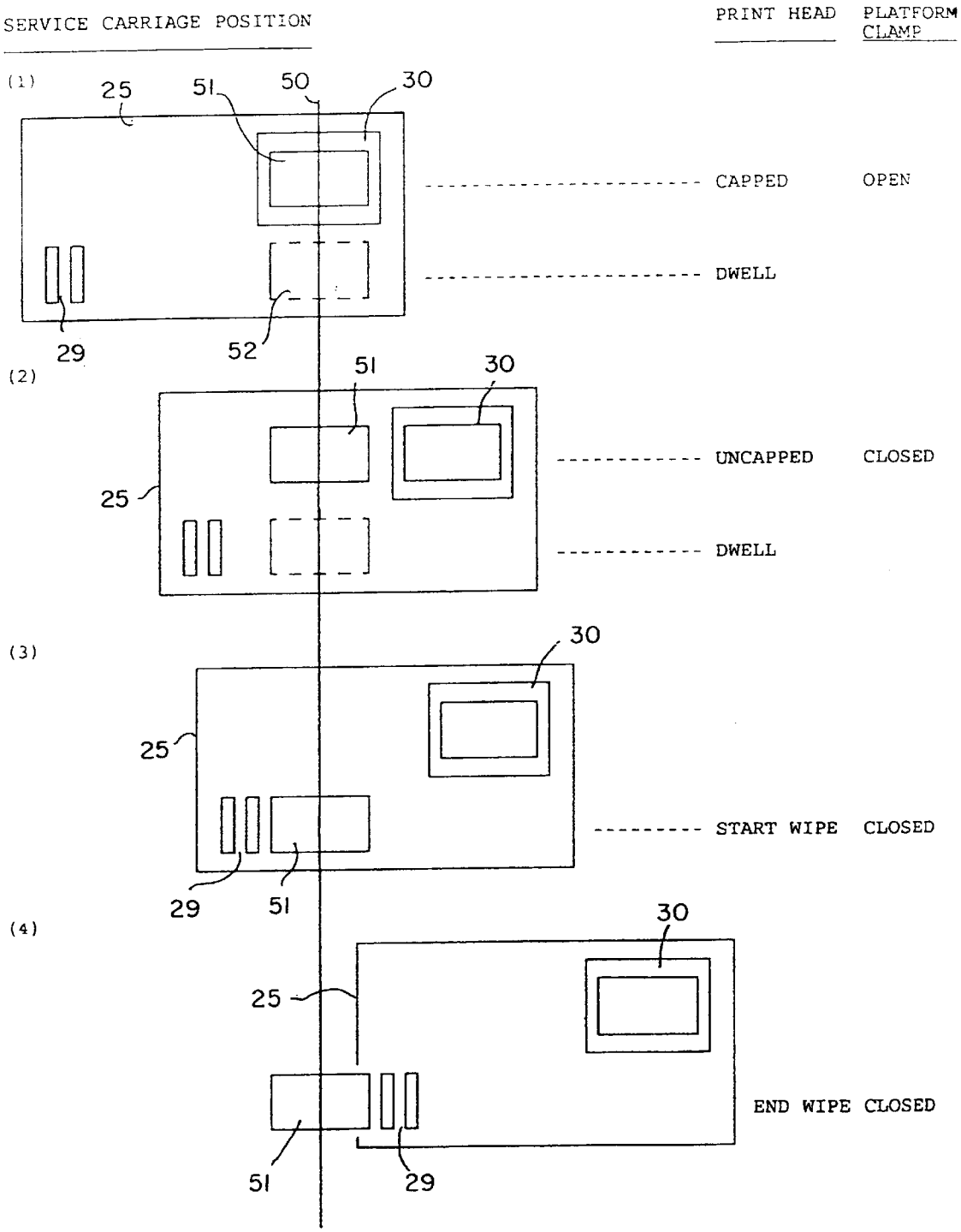
FIG. 5 illustrates operation of the service station and a platform of the printer.

Reference is now made to FIG. 5 which illustrates the actions of capping and wiping the print head and the state of the platform clamp in relation to four positions, (1), (2), (3) and (4) of the service carriage 25. The traversal of the print head carriage in the direction of arrow 11 is indicated by line 50 and the operative face of the print head containing the ink jet nozzles is indicated by 51. In position (1) of the carriage, and with the print head aligned with the capping element 30, the print head is capped by the capping element. The platform 18 is held by the cam surface 35 away from the chassis plate 17 and hence the clamp is open. In position (2) of the service carriage, the capping element is displaced from the print head and hence the print head is uncapped. Movement of the service carriage from position (1) to position (2) pivots the cam lever 33 and thereby permits the platform to move under the action of the springs toward the chassis plate 17 and hence the clamp is closed.

In position (3) of the service carriage, and with the print head aligned with the wiping elements 29, the wiping elements are located adjacent the operative face of the print head to commence a wiping action across the operational face of the print head. In position (4) of the service carriage, the wiping elements have passed across the operational face of the print head and the wiping action is complete. Movement of the service carriage from position (2) through position (3) to position (4) does not cause any pivoting of the cam lever 33 and hence the platform remains urged under the action of the springs toward the chassis plate and hence the clamp remains closed.

When the service carriage is located in positions (1) and (2), the print head may be located in a dwell position aligned with the wiping elements but not acted on either by the wiping elements or by the capping element.

When the printer remains unused for a period greater than a predetermined period of time, the print head is located in alignment with the capping element and the service carriage is located in position (1) so that the print head is capped. With the service carriage located in position (1), the platform clamp is open so that a print receiving medium may be inserted into the printed. A printing operation may be initiated by sensing of insertion of the media or by other means. Upon initiation of a printing operation, the service carriage is moved to position (2) thereby uncapping the print head and permitting the print head to be moved from the service station to the printing station and closing the platform clamp to hold and retain the media. On completion of a printing operation, the print head is returned to the service station to a dwell position indicated at 52 to await initiation of a further print operation and the service carriage is moved to position (1) so as to open the platform clamp and thereby release the media for removal from the printer and await receipt of further print receiving media.

Wiping of the print head may be effected periodically for example after a completion of a predetermined number of printing operations. With the print head in the dwell position 52, upon initiation of a printing operation the service carriage is moved from position (1) but instead of stopping in position (2), the service carriage is moved through position (3) to position (4) thereby causing the wiping elements to be wiped across the operational face of the print head. The print head is then traversed to and across the printing station and after completion of the printing operation the print head is returned to the dwell position 52 and the service carriage is returned to position (1) to release the print receiving media.

The printer described hereinbefore is particularly suitable for printing postage indicia on mail pieces in a postage meter. A mail piece is inserted into the printer between the chassis plate 17 and the platform 18 with the upper right hand corner of the mail piece aligned with the aperture 16 in the chassis plate to receive an imprint of a required postage indicium. However the printer is not limited to use for printing postage indicia and may be utilised for printing on other print receiving media.

Figure 6:
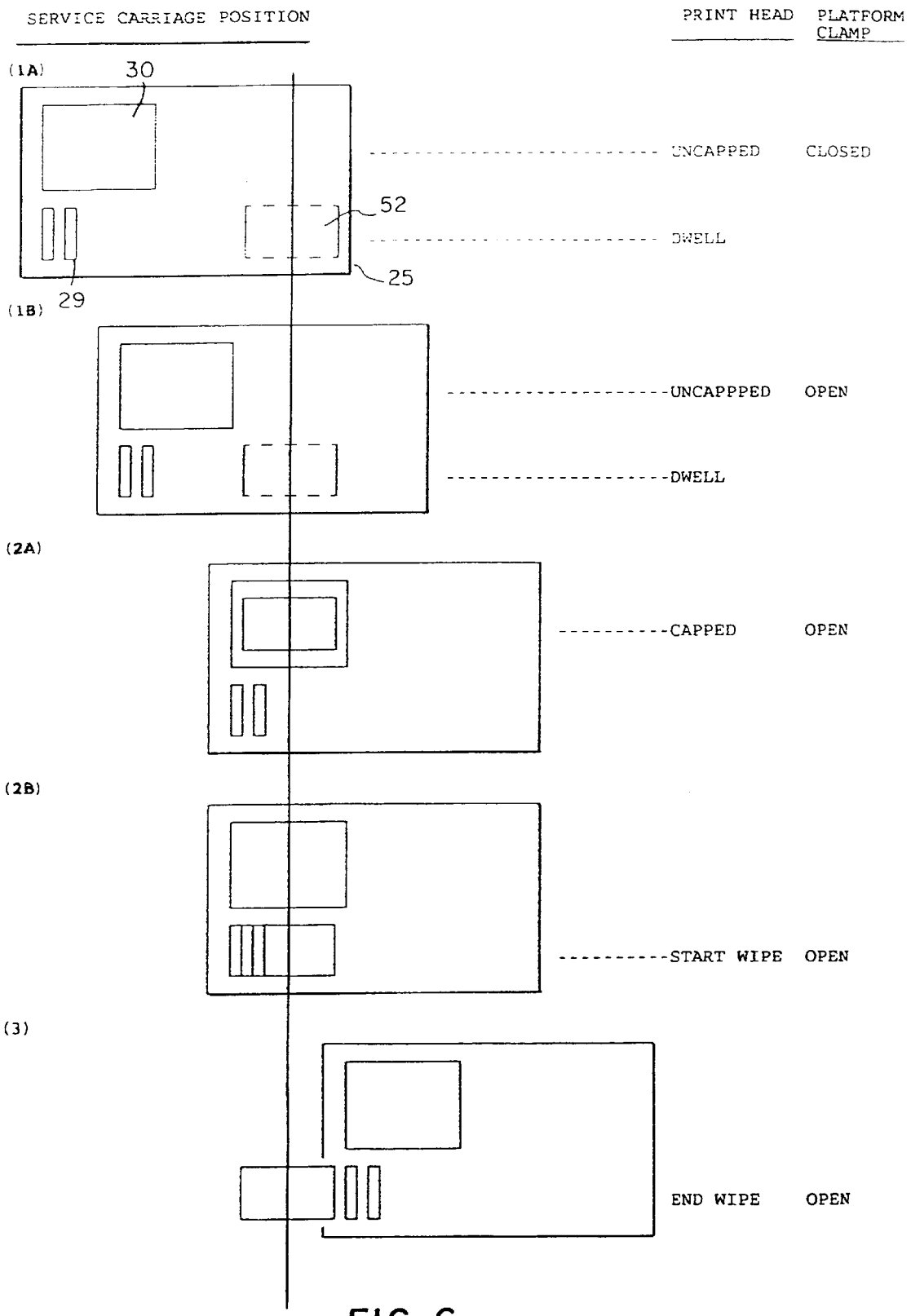
FIG. 6 illustrates operation of a modified service station and a platform of the printer.

FIG. 6 illustrates the actions of capping and wiping the print head and the state of the platform clamp in relation to positions of a modified service carriage 25. In the operation of the service carriage described with reference to FIG. 5, the service carriage has a first position in which the capping element caps the print head, a second position in which the print head has a dwell position and is not engaged by either the capping element or the wiping elements and a third position in which the wiping elements engage the print head. In the operation of the modified service carriage illustrated in FIG. 6, in first positions (1A) and (1B) of the service carriage the print head has a dwell position in which it is uncapped and is not engaged by the wiper elements. In a third position, if the head is aligned with the capping element as in (2A), the head is capped. Alternatively if the print head is aligned with the wiper elements as in (2B) the wiper elements start to wipe the print head and movement of the service station to a fourth position (3) completes wiping of the print head. When the service station carriage is in the first position (1A) the platform is closed. When the service station is moved to the second position (1B) the platform is moved to the open position and remains open when the service station moves to positions (2A), (2b) and (3).

We claim:

1. An ink jet printer including a printing station and a service station; print head transport means to move an ink jet print head in traverses in a first direction in the printing station and the service station; said service station including a carriage carrying wiping and capping elements and selectively operable drive means to move the carriage in a second direction transverse to said first direction to bring the wiping and capping elements selectively into engagement with the print head when the print head is located in the service station; support means to support print receiving media at the printing station to receive an imprint by operation of the print head during a traverse of the print head in the printing station; said support means having an open state permitting entry and removal of print receiving media respectively to and from the printing station and a closed state effective to hold the print receiving media in the printing station; and mechanical means operable by movement of the carriage to move the support means from one of said closed and open states to the other of said closed and open states.

2. An ink jet printer as claimed in claim 1 including resilient means urging the support means from the open state to the closed state.

3. An ink jet printer as claimed in claim 1 including resilient means urging the support means from the open state to the closed state and wherein the mechanical means is operable to move the support means against the urging of the resilient means from the closed state to the open state.

4. An ink jet printer as claimed in claim 1 wherein the support means is moved by the mechanical means to the open state when the carriage is moved to a first service location by the drive means.

5. An ink jet printer as claimed in claim 4 wherein the capping element is aligned for engagement with the print head when the carriage is in the first service location.

6. An ink jet printer as claimed in claim 4 wherein the wiping element is aligned for engagement with the print head when the carriage is in a second service location spaced from the first service location.

7. An ink jet printer as claimed in claim 4 wherein the capping element is aligned for engagement with the print head when the carriage is in the first service location and the wiping element is aligned for engagement with the print head when the carriage is in a second service location spaced from the first service location.

8. An ink jet printer as claimed in claim 7 wherein the carriage has a third service location intermediate the first and second service locations, the capping element and the wiping element being un-aligned with the print head when the carriage is in said third service location.

9. An ink jet printer as claimed in claim 4 wherein the wiping element and the capping element are aligned for engagement with the print head when the carriage is in the first service location.

10. An ink jet printer as claimed in claim 9 wherein the carriage has a second service location, the capping element and the wiping element being un-aligned with the print head when the carriage is in said second service location.

11. An ink jet printer as claimed in claim 1 wherein the wiping element is displaced in the first direction relative to the capping element and the print head is moved in the first direction to a first print head location for engagement by the wiping element and the print head is moved in the first direction to a second print head location for engagement by the capping element.

12. An ink jet printer as claimed in claim 1 wherein the mechanical means is operative to move the support means to the open state in response to the carriage being moved to align the capping element for engagement with the print head.

* * * * *